United States Patent [19]

Piotrowski et al.

[11] Patent Number: 4,642,262

[45] Date of Patent: Feb. 10, 1987

[54] METHOD OF MAKING FIBRIDS FROM THERMOPLASTICS

[75] Inventors: Bernhard Piotrowski, Lohmar; Robert Büning, Troisdorf; Bernhard Janser, Troisdorf; Egon Lang, Troisdorf, all of Fed. Rep. of Germany

[73] Assignee: Dynamit Nobel AG, Cologne, Fed. Rep. of Germany

[21] Appl. No.: 588,058

[22] Filed: Mar. 9, 1984

[30] Foreign Application Priority Data

Mar. 11, 1983 [DE] Fed. Rep. of Germany ..... 3308626

[51] Int. Cl.[4] ..... B29B 9/00; D04H 1/54

[52] U.S. Cl. ..... 428/296; 55/528; 264/12; 264/115; 428/359

[58] Field of Search ..... 264/12, 115; 428/280, 428/359, 296; 55/528

[56] References Cited

U.S. PATENT DOCUMENTS

| | | | |
|---|---|---|---|
| 2,437,263 | 3/1948 | Manning | 264/115 |
| 3,016,599 | 1/1962 | Perry, Jr. | 264/115 X |
| 3,544,078 | 1/1970 | Stupakis | 264/12 X |
| 4,001,357 | 1/1977 | Walz et al. | 264/12 |
| 4,025,593 | 5/1977 | Raganato et al. | 264/12 X |
| 4,143,196 | 3/1979 | Simm et al. | 264/115 X |
| 4,167,548 | 9/1979 | Arduini et al. | 264/12 |
| 4,189,455 | 2/1980 | Raganato et al. | 264/12 |
| 4,211,737 | 7/1980 | Di Drusco et al. | 264/12 |

FOREIGN PATENT DOCUMENTS

| | | | |
|---|---|---|---|
| 1934541 | 1/1971 | Fed. Rep. of Germany | 264/181 |
| 2,551,532 | 5/1976 | Fed. Rep. of Germany | 264/12 |
| WO81/02855 | 10/1981 | PCT Int'l Appl. | 264/12 |

*Primary Examiner*—Philip Anderson

*Attorney, Agent, or Firm*—Felfe & Lynch

[57] ABSTRACT

Disclosed is a method of making fibrids from thermoplastics synthetics and copolymers thereof by expanding by vaporization, in the presence of a gaseous propellant, a polymer solution under elevated pressure and elevated temperature in a mixing nozzle under shear inducing conditions wherein the true or apparent solution of the polymer in solvent is expanded by the use of superheated steam having an average energy density of at least 50 watt-seconds per cubic centimeter in the mixing nozzle.

9 Claims, 2 Drawing Figures

$$L = \frac{d_2 - d_{min.}}{2 \cdot \tan 5°}$$

METHOD OF MAKING FIBRIDS FROM THERMOPLASTICS

BACKGROUND OF THE INVENTION

The invention relates to a method of making fibrids from thermoplastics such as polyolefins, polyvinyl halides, polyvinylidene halides, other polymers on the basis of vinyl derivatives, as, for instance, polyvinyl esters, polyvinyl pyrrolidone, polyvinyl lactam, polyamides, polyesters, polyacrylonitrile, polyurethanes and their copolymers and the like, by expansion evaporation, in the presence of a gaseous propellant, of a corresponding polymer solution under elevated pressure and elevated temperature in a two-substance mixing nozzle under shear-inducing conditions, as well as the application of a process of the stated kind.

The term "fibrids", as used herein, is to be understood to refer to fibers which are highly oriented in the longitudinal direction and have a cellulose-like structure of up to several millimeters in length (cf. Angewandte Chemie, 90, 833/1978).

Various procedures are known for the preparation of fibrids from thermoplastics, and they differ in the manner of energy input for the work to be performed in forming fibrids from a liquid phase, e.g., by shear with cooling, precipitation or vaporization of the liquid phase.

Therefore, in the case of shear-induced crystallization, fibrids of polyethylene are formed under the action of turbulent vortices by the cooling of an approximately 5 wt-% solution of polyethylene in a solvent.

Fibrids can also be formed by the precipitation of the polymer from a solution by means of a liquid serving as precipitating agent (DE-AS No. 1,469,120) or by cooling under the shearing action of rotating elements or of a turbulent stream of liquid.

Another method of preparing fibrids sets out from a polymer film stretched along one axis. By mechanical comminution in an appropriate apparatus, the use of a precipitating agent is rendered unnecessary (U.S. Pat. No. 3,693,851).

In the preparation of fiber-like products from the solution of a polyolefin by expansion vaporization of the solvent (DE-AS No. 2,227,021), the energy required for the production of the shearing forces and for the vaporization of the solvent is taken from the melting heat of the polymer and from the system by expansion through a throttle valve of a solution of the polymer, which is under elevated pressure and elevated temperature.

The disadvantage of this method consists in the necessity, for the evaporation of the solvent and the achievement of the required high velocities of more than 50 $ms^{-1}$ in the liquid phase ahead of the throttle valve, of a high pressure and a temperature so high that it is often higher than the melt temperature or molten solution temperature, as the case may be, of the dissolved polymer.

Particularly in the case of polymers sensitive to degradation, such as polyvinylidene fluoride or even polyvinyl chloride, for example, there are limits to the use of the above-described method above the melting temperature of the polymer or the molten solution temperature.

Another limitation of the expansion vaporization process is to be seen in the fact that the rate of vaporization and the velocity of flow are established by the temperature and pressure of the polymer solution. As a result, the dimensions of the fiber-like particles thus obtained, such as their length, for example, have to be reduced by subsequent operations, such as grinding.

In a modification of the expansion vaporization process, gaseous nitrogen is additionally used as the propellant, and the evaporation is produced in a two-substance mixing nozzle (cf. G.B. Pat. No. 1,491,050 relating to the production of fibrids from polyolefins).

It is the object of the invention to further improve the expansion vaporization process such that true fibrids can be produced by thermoplastic substances, even from polymers, such as PVDF, which are sensitive to degradation at temperatures only slightly above the melting point, without the need to add mechanical comminution processes. to arrive at fibrids and porous structures prepared therefrom. These fibrids are characterized by a large specific surface area and other desired properties.

The various features of novelty which characterize the invention are pointed out with particularity in the claims annexed to and forming a part of this specification. For a better understanding of the invention, its operating advantages and specific objects obtained by its use, reference should be had to the accompanying drawing and descriptive matter in which there is illustrated and described a preferred embodiment of the invention.

DESCRIPTION OF THE INVENTION

Figure 1:
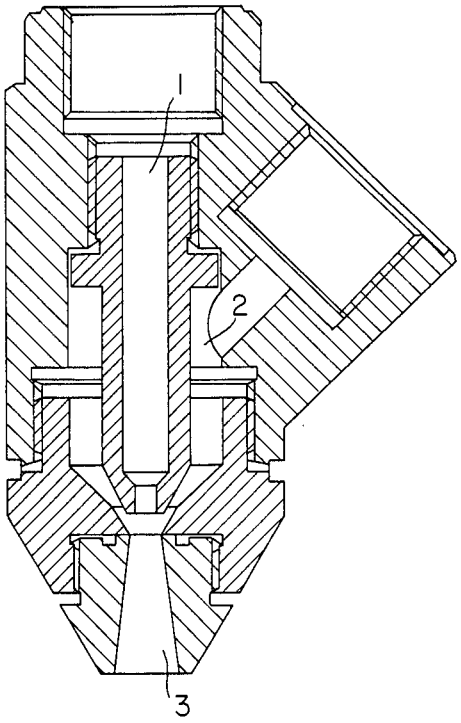
FIG. 1 shows a cutaway view of a nozzle suitable for use in the practice of the invention.

This object is achieved in accordance with the invention, in a process of the kind described above, by the expansion of a true or apparent solution of the polymer in a solvent in a two-substance mixing nozzle by the use of superheated steam at an average energy density of at least 50 $Ws/cm^3$ (waH-seconds per cubic centimeter).

Most of the solvent is instantaneously converted to the gaseous phase, and the polymer undergoes an orientation in the shear field that is forming, and is converted to the fibrid form.

The conditions of the flow in the two-substance mixing nozzle are preferably adjusted such that the steam velocity amounts to at least ten times the velocity of the polymer solution.

The ratio of the mass of the steam to the mass of the solvent is a maximum of 3:1, and is preferably 1:1.

A nonwoven can be prepared from the fibrids made by the method of the invention by capturing the formed fibrids separately and consolidating them directly into a mat-like material, while the mixture of steam and solvent vapor is delivered directly to a suitable reprocessing stage.

In accordance with the invention, the energy needed for the formation of the fibrids is not obtained from the heat stored in latent form by the melted polymer and the solvent, so as to assure the predominant vaporization of the solvent in the expansion process. The steam used in accordance with the invention serves simultaneously for the transfer of the kinetic energy to the polymer stream and for the evaporation of the solvent of the polymer solution. It will suffice to increase the temperature of the solvent until a uniform liquid phase of the polymer is present in the solvent.

Depending upon the concentration and the molar mass of the polymer, the necessary temperature of the solution will not generally exceed the melting temperature of the polymer.

Fundamentally suitable solvents for PVDF are the known aprotic polar solvents, of which dimethylformamide, dimethylacetamide, N-methylpyrrolidone and dimethylsulfoxide apparently dissolve PVDF at 20° to 25° C., while acetone does so at elevated temperature. These solvents can be used alone or in mixtures, even with acetone, for example. A comprehensive enumeration of other solvents for PVDF is to be found in U.S. Pat. No. 3,376,370.

As regards suitable solvents for other thermoplastics than PVDF, the technical literature can be consulted.

Solvents are preferred whose boiling temperature is lower than the melting temperature of the pure polymer, and which can be separated without great difficulty from the aqueous mixture produced in the process of the invention.

In accordance with the invention, a high velocity propulsion of the polymer solution, which can contain a percentage of gaseous solvent, is achieved by means of a jet of steam with a velocity of at least 300 $ms^{-1}$, preferably 400 $ms^{-1}$, in a two-substance mixing nozzle operating on the principle of a Laval nozzle in which the steam flows in the same direction as the polymer solution. The liquid stream is broken up and the solvent is vaporized and carried out by the steam. An average energy density of at least 50 $Ws/cm^3$ is achieved in the shear field.

Through the use of superheated steam, a higher velocity is achieved in the nozzle orifice and a higher average energy density, in comparison to the use of nitrogen as propellant at the same pressure gradient. Thus, a larger amount of heat is additionally available to the system for the evaporation of the solvent.

The discharge mixture is in the form of fibrids of the thermoplastic polymer, and a gas phase composed of water vapor and solvent vapor, as well as a condensed liquid phase of water and solvent plus traces of the polymer.

The fibrids produced by the method of the invention can be consolidated directly into a mat-like tissue by capturing them from the gas stream, on a sieve-like fabric for example.

On the basis of the ratio of the mass of the polymer solution to the mass of the input steam, and of the temperature and concentration of the polymer solution, it is possible to control the average thickness and length of the fibrids, i.e., their size spectrum, and to control their specific surface and crystal structure. At constant polymer concentration, a decrease of the relation of the mass of polymer solution to the mass of steam results in finer and smaller fibrids. The same is true when the solution temperature is increased.

Thus, the fibrids prepared by the method of the invention and the nonwovens prepared therefrom are distinguished by special properties, such as very high specific surface area values of up to 140 $m^2g^{-1}$ (BET), and in the case of PVDF fibrids, a high thermal stability and resistance to oxidizing media, and, on the basis of the high percentage of the desired crystal form I (cf. J. Polym. Sci. Part A, Vol. 3, 4263 ff., 1965) that is attainable, they are characterized by interesting dielectric properties.

The mass ratio of steam to polymer solution required for the evaporation of the solvent and the disintegration of the polymer amounts to no more than 3:1, and is preferably around 1:1 or less. At the same time the average energy density is determined essentially by the high steam velocity of at least 300 $ms^{-1}$, which is elevated definitely above the critical velocity by designing the two-substance nozzle as a Laval nozzle. It is thus possible to achieve a very high average energy density of, for example, 100 $Ws/cm^3$, with relatively inexpensive apparatus and a relatively small mass of the steam to serve as the auxiliary medium.

Figure 2:
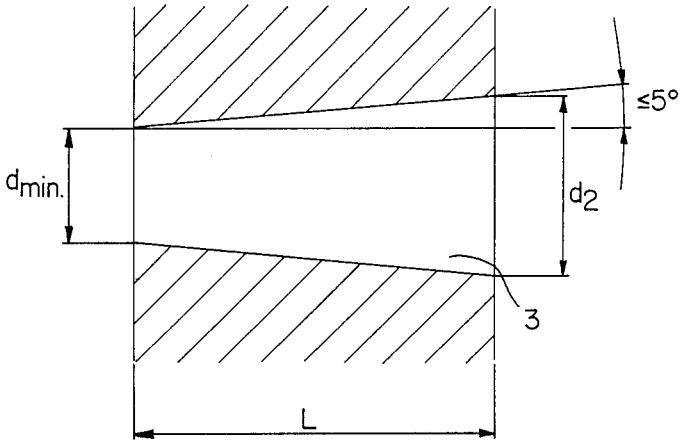
FIG. 2 shows the Laval nozzle center piece.

Suitable for the practice of the method of the invention are two-substance mixing nozzles of circular cross section, shown in FIG. 1 in which the polymer solution is injected centrally (1) and the steam is delivered through an annular cross section (2) laterally against the polymer solution. The diameter of the central bore through which the polymer solution is introduced amounts preferably to 0.5 to 1 mm. The annular cross section of the two-substance mixing nozzle for the injection of the steam corresponds to an equivalent diameter of preferably 1 to 2 mm. The method of the invention was practised with a commercially available two-substance mixing nozzle to which a Laval nozzle center-piece was attached. The principle of the Laval nozzle center-piece is shown in FIG. 2.

A suitable nozzle is defined by the formula $$L = d_2 - d_{min}/2 \cdot \tan 5°$$

wherein:

L = length of the Laval nozzle;

$d_2$ = outlet cross section;

$d_{min}$ = inlet cross station;

5° = angle between the inner wall of the Laval nozzle and the perpendicular to the cross section of the nozzle; and tan = tangent.

The steam temperature will depend upon the nature of the starting material selected for the production of the fibrids, and it is typically around 150° C. (423° K.) for PVDF or PVC. The steam temperature is chosen to be above the boiling temperature of the polymer solution.

To achieve a higher steam velocity, it is advantageous to design the discharge orifice (3) in the form of a Laval nozzle (FIG. 1).

The method of the invention will be further illustrated below with the aid of an example, but no limitation is to be seen either in the nature of the solvent or in the kind of polymer that is used.

EXAMPLE

In an autoclave with stirrer, acetone was heated to a temperature slightly below the boiling point at standard pressure, and PVDF was slowly added, with stirring, in the form of powder (MFI 20), until a concentration of 35% by weight, with respect to the solution, was achieved. The autoclave was closed, and the contents heated to a temperature of 98° C. The vapor pressure that established itself then amounted to about 4 bar.

In like manner a solution of PVC (S-PVC, K value 68) in acetone was prepared, the PVC passing into solution at elevated pressure at a temperature above 60° C. After the autoclave was closed, a pressure of about 2 to 4 bar was produced with nitrogen gas, for the purpose of avoiding incrustation in the vapor chamber while the heating and stirring was in progress, due to the evaporation of the acetone against the hot vessel wall.

The prepared solutions were fed through a two-substance mixing nozzle of circular cross section of 0.7 mm diameter, while steam was injected, at the temperatures given in the table and pressures of 2 to 4 bar, through the mixing nozzle at various annular cross sections with equivalent diameters of 0.8 to 1.8 mm. The variation of the mass ratios of polymer solution to steam was performed by the selection of different orifice cross sections and input pressures.

In Table 1 are given the results of tests 1 to 7, along with important properties of the fibrids, namely the specific surface and the content of crystal form I.

TABLE 1

| Test No. | 1 | 2 | 3 | 4 | 5 | 6 | 7 |
|---|---|---|---|---|---|---|---|
| Polymer concentration (wt-%) | | | | | | | |
| PVDF | 7 | 7 | 7 | 25 | 25 | — | — |
| PVC | — | — | — | — | — | 5 | 25 |
| Temperature (K.) | | | | | | | |
| Polymer sol. | 371 | 371 | 371 | 371 | 371 | 371 | 371 |
| Steam | 423 | 423 | 423 | 423 | 423 | 423 | 423 |
| Pressure (bar) | | | | | | | |
| Polymer sol. | 4 | 4 | 4 | 6 (+$N_2$) | 6 (+$N_2$) | 4 (+$N_2$) | 6 (+$N_2$) |
| Steam | 3 | 3 | 4 | 3 | 4 | 3 | 3 |
| Mixing nozzle diameter (mm) | | | | | | | |
| Polymer sol. | 0.7 | 0.7 | 0.7 | 0.7 | 0.7 | 0.7 | 0.7 |
| Steam | 0.8 | 1.8 | 1.8 | 0.8 | 1.8 | 1.8 | 1.8 |
| Mass ratio a:b | | | | | | | |
| Polymer sol. (a) Steam (b) | 1 | 0.5 | 0.3 | 1 | 0.3 | 0.5 | 0.5 |
| Specific surface (sq.m. per gram) | 25 | 60 | 90 | 20 | 70 | 40 | 25 |
| Content of crystal form I (wt-%) | 70 | 85 | 95 | 75 | 95 | — | — |

The mat-like material of PVDF fibrids, which was produced by spraying them onto a sieve-like fabric placed at a distance of 30 cm or less beneath the nozzle orifice, had a specific weight of 280 grams per square meter, and the following properties:

(a) Air permeability L=142 l/dm$^2$.min at 20° C. and a differential pressure of 2 mbar, (b) Permeability to water L=6.7 l/dm$^2$.min at 20° C. and a differential pressure of 20 mbar, (c) In the case of vacuum filtration at 20 mbar and 20° C., 88% of a dispersion consisting of water and 10% alumina tri-hydrate by weight, having a particle size of 1 $\mu m \leqq dp \leqq 50$ $\mu m$, was retained on the above-described mat, at an average filtration throughput of 2 l/dm$^2$. min.

It will be understood that the specification and examples are illustrative but not limitative of the present invention and that other embodiments within the spirit and scope of the invention will suggest themselves to those skilled in the art.

We claim:

1. A method of making fibrids from thermoplastic synthetic substances comprising expanding by vaporization, in the presence of a gaseous propellant, a polymer solution, under elevated pressure and elevated temperature, in a mixing nozzle having a Laval discharge portion under shear-inducing conditions, wherein the true or apparent solution of the polymer in a solvent is expanded by the use of superheated steam at an average energy density of at least 50 watt-seconds per cubic centimeter in the mixing nozzle

2. The method of claim 1, wherein the steam velocity is at least ten times the velocity of the polymer solution.

3. The method of claim 1, wherein the steam velocity is at least 300 ms$^{-1}$, preferably 400 to 800 ms$^{-1}$.

4. The method of claim 1, wherein the mass ratio of the steam to solvent is a maximum of 3:1, preferably 1:1.

5. The method of claim 1, wherein the fibrids are made from PVDF, PVC or copolymers of PVDF or PVC with a content of at least 50 wt.-% of PVDF or PVC, and acetone as solvent, the solution having a temperature of 90° to 150° C. and the concentration of the polymer ranging from 0.5 to 35% by weight.

6. The method of claim 1, wherein the thermoplastic synthetic is selected from the group comprising polyolefins, polyvinyl halides, polyvinylidene halides, other polymers on the basis of vinyl derivatives, polyamides, polyesters, polyacrylonitrile, polyurethanes, their copolymers and the like.

7. The method of claim 1, wherein the mixing nozzle is a two substance mixing nozzle.

8. An article produced according to the method of claim 1.

9. An article of claim 8, wherein the article is a porous sheet material, mat or other filtration means.

* * * * *